US007541326B2

(12) United States Patent
Lang

(10) Patent No.: US 7,541,326 B2
(45) **Date of Patent: *Jun. 2, 2009**

(54) LIQUID WASHING AGENT CONTAINING A COLOR FIXING AGENT

(75) Inventor: Frank-Peter Lang, Hattersheim (DE)

(73) Assignee: Clariant Produkte (Deutschland) GmbH, Frankfurt (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/662,535

(22) PCT Filed: Sep. 6, 2005

(86) PCT No.: PCT/EP2005/009546

§ 371 (c)(1),
(2), (4) Date: Jul. 24, 2007

(87) PCT Pub. No.: WO2006/027203

PCT Pub. Date: Mar. 16, 2006

(65) Prior Publication Data

US 2008/0103080 A1 May 1, 2008

(30) Foreign Application Priority Data

Sep. 10, 2004 (DE) ..... 10 2004 043 728

(51) Int. Cl.
*C11D 1/28* (2006.01)
*C11D 1/72* (2006.01)
*C11D 3/37* (2006.01)
*C11D 9/02* (2006.01)

(52) U.S. Cl. ..... 510/475; 510/331; 510/340; 510/351; 510/356; 510/357; 510/360; 510/421; 510/426; 510/481; 510/504

(58) Field of Classification Search ..... 510/331, 510/340, 351, 356, 357, 360, 421, 426, 475, 510/481, 504

See application file for complete search history.

(56) References Cited

U.S. PATENT DOCUMENTS

| | | | | |
|---|---|---|---|---|
| 3,332,880 | A | 7/1967 | Kessler | |
| 4,663,071 | A | 5/1987 | Bush | |
| 5,441,672 | A | 8/1995 | Schwadtke | |
| 5,783,548 | A | 7/1998 | Fredj | |
| 2002/0193280 | A1 * | 12/2002 | Lang et al. | 510/499 |
| 2003/0109408 | A1 | 6/2003 | Brouwn | |
| 2003/0171249 | A1 | 9/2003 | Lang | |
| 2007/0277327 | A1 | 12/2007 | Wessling et al. | |

FOREIGN PATENT DOCUMENTS

| | | |
|---|---|---|
| DE | 102004043728 | 6/2005 |
| DE | 102004051010 | 6/2005 |
| EP | 0341205 | 11/1989 |
| EP | 0384070 | 8/1990 |
| EP | 0704523 | 4/1996 |
| EP | 1236793 | 9/2002 |
| EP | 1239025 | 12/2002 |
| GB | 1082179 | 9/1967 |
| WO | 9220769 | 11/1992 |
| WO | 0100767 | 1/2001 |
| WO | 03038029 | 5/2003 |

OTHER PUBLICATIONS

Int'l Search Report for PCT/EP2005/009546, mailed Oct. 28, 2005.
English Lang. Trans. of Int'l Preliminary Examination Report PCT/EP2005/009546, Jul. 30, 2007.
Copending U.S. Appl. No. 11/665,512, filed Apr. 13, 2007.
Copending U.S. Appl. No. 11/665,511, filed Apr. 13, 2007.
Copending U.S. Appl. No. 11/666,039, filed Apr. 20, 2007.
Copending U.S. Appl. No. 11/666,038, filed Apr. 20, 2007.

* cited by examiner

*Primary Examiner*—Brian P Mruk
(74) *Attorney, Agent, or Firm*—Richard P. Silverman

(57) ABSTRACT

This invention relates to liquid washing and cleaning agents containing a secondary alkane sulphonate, soap and a non-ionic surfactant as a surfactant and homo and/or copolymers of diallyl-dimethyl-ammonium chloride or reaction products of cyanamides comprising aldehydes and ammonium salts or monoamines and/or polyamines with epichlorhydrine, or polyamines with cyanamides and amido sulphuric acid as color fixing agents.

15 Claims, No Drawings

LIQUID WASHING AGENT CONTAINING A COLOR FIXING AGENT

The invention relates to liquid washing and cleaning compositions for textiles, which comprise one or more dye fixatives.

In addition to the washing powders, liquid washing compositions constitute a very important product group among the washing compositions for textiles today.

Liquid washing compositions comprise surfactants as a main constituent. In modern washing compositions, generally several surfactants are used simultaneously. In this context, it has been found that the combination of anionic and nonionic surfactants is useful.

Typically, the anionic surfactants used are linear alkylbenzenesulfonates (LAS), fatty alcohol sulfates (FAS), secondary alkanesulfonates (SAS) and in some cases also fatty alcohol ether sulfates (FAES). The nonionic surfactants used are ethoxylates of long-chain synthetic alcohols, for example of the oxo alcohols, or of native fatty alcohols.

As further essential constituents, builders, for example polycarboxylates, and solubilizers, for example ethanol, glycerol or propanediol, are used.

In general, additionally present in small use concentrations are additive constituents which can be summarized under the term "washing assistants" and which thus include different active substance groups such as foam regulators, graying inhibitors, soil release polymers, enzymes, optical brighteners, dye transfer inhibitors and dye fixatives.

The dye fixatives prevent the fading of colored textiles, which occurs over several wash cycles particularly in the case of dark-colored textiles made of cotton and cotton blend fabrics. In the case of high-quality dyed textiles, fading of the colors takes place over a longer period of use.

When, in contrast, the dyes of a dyed textile are poorly fixed, i.e. the textile "bleeds", the dye fixatives act simultaneously as dye transfer inhibitors and prevent staining of differently colored or white textiles washed at the same time.

Unfortunately, the use of dye fixatives in liquid washing compositions is in practice restricted to nonionic formulations, i.e. to formulations which do not comprise any anionic surfactants. The reason for this lies in the lack of compatibility of the anionic surfactants with the dye fixatives, which leads to flocculation, precipitation or phase separation of the components.

On the other hand, it is impossible to dispense with anionic surfactants if the washing composition formulation is to have very good washing capability.

The purpose of the present invention is to provide liquid washing and cleaning composition formulations for textiles, which comprise one or more dye fixatives in combination with an anionic surfactant and which, in spite of the incompatibility of the components, are both physically and chemically stable.

It has been found that, surprisingly, this aim can be achieved by a ternary surfactant system in which the anionic surfactant present is secondary alkanesulfonate in combination with soap and a nonionic surfactant.

The invention provides liquid washing and cleaning compositions comprising a) secondary alkanesulfonate
b) soap
c) a nonionic surfactant and
d) a dye fixative from the group of the homo- and copolymers of diallyldimethylammonium chloride or the reaction products of cyanamides with aldehydes and ammonium salts or cyanamides with aldehydes and monoamines or monoamines and/or polyamines with epichlorohydrin or polyamines with cyanamides and amidosulfuric acid.

The individual components are described below:

In secondary alkanesulfonates, the alkyl group may either be saturated or unsaturated, may be branched or linear and may optionally be substituted by a hydroxyl group.

The sulfo group may be at any position in the carbon chain, but the primary methyl groups at the start and end of the chain do not have any sulfonate groups.

The preferred secondary alkanesulfonates contain linear alkyl chains having from approx. 9 to 25 carbon atoms, preferably from approx. 10 to 20 carbon atoms and more preferably from approx. 13 to 17 carbon atoms. The cation is, for example, sodium, potassium, ammonium, mono-, di- or triethanolammonium, calcium or magnesium. It is also possible to use mixtures of different cations.

Very particular preference is given to secondary $C_{13-17}$-alkanesulfonate, sodium salt, which is obtainable, for example, under the trade names Hostapur SAS (Clariant), Leuna alkanesulfonate or emulsifier E30 (Leuna-Tenside GmbH) or Marlon PS (Sasol).

Secondary alkanesulfonate is used in the inventive liquid washing compositions in a concentration of from 5 to 20% by weight, preferably from 7 to 17% by weight and more preferably from 7 to 13% by weight.

Soap comprises the salts of long-chain native fatty acids. The fatty acid used for soaps in liquid washing compositions is in particular coconut fatty acid, which constitutes mainly a mixture of $C_{12}$ and $C_{14}$ fatty acid. However, it is also possible to use longer-chain fatty acids such as oleic acid, soybean fatty acid, tallow fatty acid, stearic acid, behenic acid or mixtures thereof. It is possible to use the fatty acids as soaps in the form of their sodium, potassium, ammonium, mono-, di- or triethanolammonium salts.

For liquid washing compositions, particular preference is given to the potassium, ammonium, mono-, di- or triethanolammonium salts of coconut fatty acid, of soybean fatty acid, of oleic acid and of mixtures thereof with one another or optionally with other fatty acids.

In the inventive liquid washing compositions, soap is used to an extent of from 5 to 25% by weight and preferably from 10 to 20% by weight.

Useful nonionic surfactants include in particular the ethoxylates of long-chain, aliphatic, synthetic or native alcohols having a $C_8$- to $C_{22}$-alkyl radical. These may contain from approx. 1 to approx. 25 mol of ethylene oxide.

The alkyl chain of the aliphatic alcohols may be linear or branched, primary or secondary, saturated or else unsaturated.

Preference is given to the condensation products of $C_{10}$- to $C_{18}$-alcohols with from approx. 2 to approx. 18 mol of ethylene oxide per mole of alcohol. The alcohol ethoxylates may have a narrow homolog distribution ("narrow range ethoxylates") or a broad homolog distribution of the ethylene oxide ("broad range ethoxylates"). Particular preference is given to the $C_9$-$C_{11}$ oxo alcohol with from 6 to 10 mol of EO and the $C_{12/C14}$ fatty alcohol with from 5 to 9 mol of EO. Very particular preference is given to $C_{11}$ oxo alcohol-8EO ethoxylate and $C_{12/14}$ fatty alcohol-7EO ethoxylate. The use concentration is from 10 to 30% by weight, preferably from 15 to 25% by weight and more preferably from 17 to 23% by weight.

The dye fixatives which can be incorporated into inventive liquid washing compositions are nonionic or cationic and are described below:

Polycondensates which can be used as dye fixatives are obtained by the reaction of cyanamides with aldehydes and ammonium salts and/or monoamines, by the reaction of monoamines and/or polyamines with epichlorohydrin or by the reaction of polyamines with cyanamides and amidosulfuric acid.

The monoamines used may be primary, secondary and tertiary amines. They may be aliphatic amines, for example dialkylamines, especially dimethylamine, alicyclic amines, for example cyclohexylamine, and aromatic amines, for example aniline. However, the amines used may also simultaneously have aliphatic, alicyclic and aromatic substituents. In addition, it is also possible to use heterocyclic compounds, for example pyridine.

The term "polyamines" here includes, for example diamines, triamines, tetraamines, etc, and also the analogous N-alkylpolyamines and N,N-dialkylpolyamines. Examples thereof are ethylenediamine, propylenediamine, butylenediamine, pentylenediamine, hexylenediamine, diethylenetriamine, triethylenetetraamine and higher polyamines.

Particularly preferred polyamines are ethylenediamine, diethylenetriamine and dimethylaminopropylamine.

The ammonium salts are salts of ammonia, especially ammonium chloride or the abovementioned amines or polyamines with different inorganic or organic acids, or else quaternary ammonium salts.

The cyanamides may be cyanamide or dicyandiamide.

Aldehydes which can be used for the synthesis of the dye fixatives are, for example, aliphatic aldehydes, for example formaldehyde, acetaldehyde, propionaldehyde, butyraldehyde; dialdehydes, for example glyoxal; unsaturated aldehydes, for example acrolein, crotonaldehyde and aromatic aldehydes, for example benzaldehyde. Particular preference is given to the aliphatic aldehydes, especially formaldehyde.

The dye fixatives used may also be homo- and copolymers based on diallyldimethylammonium chloride (DADMAC). Copolymers based on DADMAC contain, as further components, other vinylic monomers, for example vinylimidazole, vinylpyrrolidone, vinyl alcohol, vinyl acetate, (meth)acrylic acid/ester, acrylamide, styrene, styrenesulfonic acid, acrylamidomethylpropanesulfonic acid (AMPS), etc.

Homopolymers based on DADMAC are obtainable under the trade names Dodigen 3954, Dodigen 4033 and Genamin PDAC (from Clariant).

The dye fixatives are used in the liquid washing compositions to an extent of from 0.25 to 5% by weight, preferably to an extent of from 0.5 to 3% by weight and more preferably to an extent of from 0.5 to 1% by weight.

The inventive liquid washing compositions are preferably fluid and have a viscosity of max. 500 mPas. They may, though, also be higher-viscosity, still free-flowing gels or spreadable pastes.

Liquid washing and cleaning compositions which comprise the inventive surfactant-dye fixative combination may additionally comprise further constituents as are customary in such compositions. These are described below.

The total surfactant content of the inventive washing composition formulations may be from 10 to 70% by weight, preferably from 10 to 55% by weight and most preferably from 20 to 50% by weight.

Further Anionic Surfactants

Useful anionic surfactants include sulfates, sulfonates, carboxylates, phosphates and mixtures thereof. Suitable cations here are alkali metals, for example sodium or potassium, or alkaline earth metals, for example calcium or magnesium, and also ammonium, substituted ammonium compounds, including mono-, di- or triethanolammonium cations and mixtures thereof.

The following types of anionic surfactants are particularly preferred: alkyl ester sulfonates, alkyl sulfates, alkyl ether sulfates, alkylbenzenesulfonates, as described below.

Alkyl ester sulfonates include linear esters of $C_8$-$C_{20}$-carboxylic acids (e.g. fatty acids) which are sulfonated by means of gaseous $SO_3$.

Suitable starting materials are natural fats, such as tallow, coconut oil and palm oil, but may also be of synthetic nature.

Preferred alkyl ester sulfonates, especially for washing composition applications, are compounds of the formula

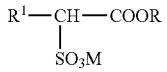

in which $R^1$ is a $C_8$-$C_{20}$-hydrocarbyl radical, preferably alkyl, and R is a $C_1$-$C_6$-hydrocarbyl radical, preferably alkyl. M is a cation which forms a water-soluble salt with the alkyl ester sulfonate. Suitable cations are sodium, potassium, lithium or ammonium cations, for example monoethanolamine, diethanolamine and triethanolamine. Preferably, $R^1$ is $C_{10}$-$C_{16}$-alkyl and R is methyl, ethyl or isopropyl. Most preferred are methyl ester sulfonates in which $R^1$ is $C_{10}$-$C_{16}$-alkyl.

Alkyl sulfates here are water-soluble salts or acids of the formula $ROSO_3M$ in which R is a $C_{10}$-$C_{24}$-hydrocarbyl radical, preferably an alkyl or hydroxyalkyl radical with $C_{10}$-$C_{20}$-alkyl component, more preferably a $C_{12}$-$C_{18}$-alkyl or hydroxyalkyl radical.

M is hydrogen or a cation, for example an alkali metal cation (for example sodium, potassium, lithium), or ammonium or substituted ammonium, for example methyl-, dimethyl- and trimethylammonium cations, or quaternary ammonium cations such as tetramethylammonium and dimethylpiperidinium cations, and quaternary ammonium cations derived from alkylamines such as ethylamine, diethylamine, triethylamine and mixtures thereof.

Alkyl chains with $C_{12}$-$C_{16}$ are preferred for low washing temperatures (e.g. below about 50° C.) and alkyl chains with $C_{16}$-$C_{18}$ are preferred for higher washing temperatures (e.g. above about 50° C.).

Alkyl sulfates are used in concentrations of from 2 to 25% by weight, preferably from 5 to 22% by weight and more preferably from 5 to 20% by weight.

Alkyl ether sulfates are water-soluble salts or acids of the formula $RO(A)_m\ SO_3M$ in which R is an unsubstituted $C_{10}$-$C_{24}$-alkyl or hydroxyalkyl radical, preferably a $C_{12}$-$C_{20}$-alkyl or hydroxyalkyl radical, more preferably a $C_{12}$-$C_{18}$-alkyl or hydroxyalkyl radical.

A is an ethoxy or propoxy unit, m is a number greater than 0, preferably from approx. 0.5 to approx. 6, more preferably from approx. 0.5 to approx. 3, and M is a hydrogen atom or a cation, for example sodium, potassium, lithium, calcium, magnesium, ammonium or a substituted ammonium cation. Specific examples of substituted ammonium cations comprise methyl-, dimethyl-, trimethylammonium and quaternary ammonium cations, such as tetramethylammonium and dimethylpiperidinium cations, and also those which are derived from alkylamines such as ethylamine, diethylamine, triethylamine or mixtures thereof. Examples include $C_{12}$-$C_{18}$ fatty alcohol ether sulfates in which the content of EO is 1, 2, 2.5, 3 or 4 mol per mole of the fatty alcohol ether sulfate, and in which M is sodium or potassium.

Owing to their high evolution of foam, the use concentration of the alkyl ether sulfates depends upon their end use. Lower concentrations are used in washing compositions for machine washing than in washing compositions for manual washing. The concentrations encountered in practice are between 1 to 20% by weight. For the present invention, preference is given to concentrations of from 1 to 10% by weight and preferably from 1 to 5% by weight.

In addition to secondary alkanesulfonates, it is also possible to use primary alkanesulfonates in the inventive washing compositions. The preferred alkyl chains and cations correspond to those of the secondary alkanesulfonates.

Further suitable anionic surfactants are alkenyl- or alkylbenzenesulfonates. The alkenyl or alkyl group may be branched or linear and may optionally be substituted by a hydroxyl group. The preferred alkylbenzenesulfonates comprise linear alkyl chains having from approx. 9 to 25 carbon atoms, preferably from approx. 10 to approx. 13 carbon atoms; the cation is sodium, potassium, ammonium, mono-, di- or triethanolammonium, calcium or magnesium and mixtures thereof.

For mild surfactant systems, magnesium is the preferred cation, while sodium is preferred for standard washing applications. The same applies to alkenylbenzenesulfonates. Alkylbenzenesulfonates are used in concentrations of from 3 to 30% by weight, preferably from 4 to 25% by weight and more preferably from 5 to 20% by weight.

The term "anionic surfactants" also includes olefinsulfonates which are obtained by sulfonation of $C_8$-$C_{24}$-α-olefins, preferably $C_{14}$-$C_{16}$-α-olefins, with sulfur trioxide and subsequent neutralization. As a result of the preparation process, these olefinsulfonates may comprise relatively small amounts of hydroxyalkanesulfonates and alkanedisulfonates. Specific mixtures of α-olefinsulfonates are described in U.S. Pat. No. 3,332,880. The use concentrations for the α-olefinsulfonates correspond to those of the alkylbenzenesulfonates.

Further useful anionic surfactants include salts of acylaminocarboxylic acids; the acyl sarcosinates which are formed by reacting fatty acid chlorides with sodium sarcosinate in an alkaline medium; fatty acid/protein condensation products which are obtained by reacting fatty acid chlorides with oligopeptides; salts of alkylsulfamidocarboxylic acids; salts of alkyl ether carboxylic acids and alkylaryl ether carboxylic acids; sulfonated polycarboxylic acids which are prepared by sulfonation of the pyrolysis products of alkaline earth metal citrates, as described, for example, in GB-1,082,179; alkyl glyceryl sulfates and alkenyl glyceryl sulfates, such as oleyl glyceryl sulfates; alkylphenol ether sulfates; alkyl phosphates; alkyl ether phosphates; isethionates, such as acyl isethionates; N-acyltaurides; alkyl succinates; sulfosuccinates; monoesters of sulfosuccinates (particularly saturated and unsaturated $C_{12}$-$C_{18}$ monoesters) and diesters of sulfosuccinates (particularly saturated and unsaturated $C_{12}$-$C_{18}$ diesters); acyl sarcosinates; sulfates of alkylpolysaccharides, such as sulfates of alkylpolyglycosides, branched primary alkyl sulfates and alkylpolyethoxycarboxylates, such as those of the formula $RO(CH_2CH_2)_kCH_2COO^-M^+$ in which R is $C_8$- to $C_{22}$-alkyl, k is from 0 to 10 and M is a cation.

Nonionic surfactants which can be used in addition to those mentioned at the outset.

Condensation products of ethylene oxide with a hydrophobic base, formed by condensation of propylene oxide with propylene glycol.

The hydrophobic moiety of these compounds preferably has a molecular weight from approx. 1500 to approx. 1800. The addition of ethylene oxide onto this hydrophobic moiety leads to an improvement in the water solubility. The product is liquid up to a polyoxyethylene content of approx. 50% of the total weight of the condensation product, which corresponds to a condensation with up to approx. 40 mol of ethylene oxide. Commercially available examples of this product class are the Pluronic® brands of BASF and the ®Genapol PF brands of Clariant GmbH.

Condensation products of ethylene oxide with a reaction product of propylene oxide and ethylenediamine.

The hydrophobic unit of these compounds consists of the reaction product of ethylenediamine with excess propylene oxide and generally has a molecular weight of from approx. 2500 to 3000. Ethylene oxide is added onto this hydrophobic unit until the product has a content of from approx. 40 to approx. 80% by weight of polyoxyethylene and a molecular weight of from approx. 5000 to 11 000. Commercially available examples of this compound class are the ®Tetronic brands from BASF and the ®Genapol PN brands of Clariant GmbH.

Polyethylene oxide, polypropylene oxide and polybutylene oxide condensates of alkylphenols.

These compounds include the condensation products of alkylphenols having a $C_6$-$C_{20}$-alkyl group, which may be linear or branched, with alkene oxides. Preference is given to compounds having from approx. 5 to 25 mol of alkene oxide per mole of alkylphenol. Commercially available surfactants of this type are, for example, Igepal® CO-630, Triton® X-45, X-114, X-100 and X102, and the ®Arkopal-N brands of Clariant GmbH. These surfactants are referred to as alkylphenol alkoxylates, for example alkylphenol ethoxylates.

Semipolar Nonionic Surfactants

This category of nonionic compounds includes water-soluble amine oxides, water-soluble phosphine oxides and water-soluble sulfoxides, each having an alkyl radical of from approx. 8 to approx. 18 carbon atoms. Semipolar nonionic surfactants are also amine oxides of the formula

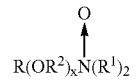

where R is an alkyl, hydroxyalkyl or alkylphenol group with a chain length of from approx. 8 to approx. 22 carbon atoms. $R^2$ is an alkylene or hydroxyalkylene group having from approx. 2 to 3 carbon atoms or mixtures thereof, each radical $R^1$ is an alkyl or hydroxyalkyl group having from approx. 1 to approx. 3 carbon atoms or a polyethylene oxide group having about 1 to about 3 ethylene oxide units, and x is a number from 0 to about 10. The $R^1$ groups may be joined together via an oxygen or nitrogen atom and thus form a ring.

Particularly preferred amine oxides are $C_8$-$C_{18}$-alkyldimethylamine oxides and $C_8$-$C_{12}$-alkoxyethyidihydroxyethylamine oxides and $C_8$-$C_{18}$ fatty acid amidoalkyldimethylamine oxides. Amine oxides may be used in use concentrations of from 0.5 to 10% by weight and preferably from 1 to 5% by weight.

Fatty Acid Amides

Fatty acid amides have the formula

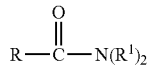

in which R is an alkyl group having from approx. 7 to approx. 21, preferably from approx. 9 to approx. 17, carbon atoms, and $R^1$ is in each case hydrogen, $C_1$-$C_4$-alkyl, $C_1$-$C_4$-hydroxyalkyl or $(C_2H_4O)_xH$ where x varies from about 1 to about 3. Preference is given to $C_8$-$C_{20}$ fatty acid amides, in particular the corresponding monoethanolamides, diethanolamides and isopropanolamides. These may be used in concentrations of from 0.5 to 5% by weight and in particular from 0.5 to 3% by weight.

Further suitable nonionic surfactants are alkyl- and alkenyloligoglycosides, and also fatty acid polyglycol esters or fatty amine polyglycol esters each having from 8 to 20, preferably from 12 to 18, carbon atoms in the fatty alkyl radical, alkoxylated triglycamides, mixed ethers or mixed formyls, alkyloligoglycosides, alkenyloligoglycosides, fatty acid N-alkylglucamides, phosphine oxides, dialkyl sulfoxides and protein hydrolyzates.

Zwitterionic Surfactants

Typical examples of amphoteric or zwitterionic surfactants are carbobetaines, sulfobetaines, aminoglycinates or amphoteric imidazolinium compounds.

Zwitterionic surfactants preferred for use in the inventive liquid washing compositions are the carboxymethylammoniobetaines, especially $C_8$- to $C_{18}$-alkyldimethylcarboxymethylammoniobetaines, $C_8$- to $C_{18}$-alkylamido-propyldimethylcarboxymethylammoniobetaines and $C_8$- to $C_{18}$-alkyldipolyethoxycarboxymethylammoniobetaines.

Further betaines are, for example, the N-carboxyethylammoniobetaines analogous to the compounds detailed above, for whose synthesis chloropropionic acid and its salts are used in place of chloroacetic acid and its salts. Examples thereof are the $C_{12}$-$C_{18}$-alkylaminopropionates and $C_{12}$-$C_{18}$-alkyliminodipropionates as the alkali metal and mono-, di- and trialkylammonium salts. A preferred sulfobetaine is $C_{12}$-$C_{18}$-alkyldimethylsulfopropylbetaine.

Amphosurfactants based on imidazoline are supplied under the trade names Miranol® and Steinapon®. Preference is given to the sodium salt of 1-(carboxymethyloxyethyl)-1-(carboxymethyl)-2-laurylimidazolinium.

The zwitterionic surfactants are used as cosurfactants. Their use concentration is from 1 to 10% by weight, preferably from 3 to 5% by weight.

Further washing composition ingredients which may be present in the present invention include inorganic and/or organic builders in order to reduce the hardness of the water.

Inorganic builders comprise, for example, alkali metal, ammonium and alkanolammonium salts of polyphosphates, for instance tripolyphosphates, pyrophosphates and glasslike polymeric metaphosphates, phosphonates, silicates, carbonates including bicarbonates and sesquicarbonates, and aluminosilicates, as described below:

Aluminosilicate builders, especially zeolites having the formula $Na_z[(AlO_2)_z(SiO_2)_y]\cdot xH_2O$ where z and y are integers of at least 6, the ratio of z to y is from 1.0 to about 0.5, and x is an integer from about 15 to about 264.

Suitable ion exchangers based on aluminosilicate are commercially available. These aluminosilicates may be of crystalline or amorphous structure, and may be naturally occurring or else synthetically produced. Preferred ion exchangers based on synthetic crystalline aluminosilicates are obtainable under the name Zeolite A, Zeolite P(B) (including those disclosed in EP-A-0 384 070) and Zeolite X. Preference is given to aluminosilicates having a particle diameter between 0.1 and 10 μm.

Suitable organic builders include polycarboxyl compounds, for example ether polycarboxylates and oxydisuccinates. Reference should likewise be made to "TMS/TDS" builders from U.S. Pat. No. 4,663,071.

Other suitable builders include the ether hydroxypolycarboxylates, copolymers of maleic anhydride with ethylene or vinyl methyl ether, 1,3,5-trihydroxybenzene-2,4,6-trisulfonic acid and carboxymethyloxysuccinic acid, the alkali metal, ammonium and substituted ammonium salts of polyacetic acids, for example ethylenediaminetetraacetic acid and nitrilotriacetic acid, and also polycarboxylic acids such as mellitic acid, succinic acid, oxydisuccinic acid, polymaleic acid, benzene-1,3,5-tricarboxylic acid, carboxymethyloxysuccinic acid, and soluble salts thereof.

Preferred organic builders are polycarboxylates based on acrylic acid and/or maleic acid, for example the Sokalan CP brands (BASF) or the Acusol brands (Rohm and Haas), and also builders based on citrate, for example citric acid and its soluble salts, especially the sodium salt.

Further suitable builders are the 3,3-dicarboxy-4-oxa-1,6-hexanedioates and the related compounds.

Builders based on phosphorus are alkali metal phosphates, for instance sodium tripolyphosphate, sodium pyrophosphate and sodium orthophosphate.

Preferred builders for the present invention are phosphonates, such as ethane-1-hydroxy-1,1-diphosphonate (HEDP) and other known phosphonates. The inventive liquid washing compositions which comprise the ternary surfactant system and a dye fixative may further comprise the customary assistants which enhance the cleaning action, serve for the care of the textile to be washed or alter the use properties of the washing composition.

Suitable assistants are, for example enzymes, especially proteases, lipases, cellulases, amylases and mannanases; enzyme stabilizers; foam enhancers; foam inhibitors such as silicone oils or paraffins; corrosion inhibitors; dye transfer inhibitors; optical brighteners; UV absorbers; bleaches; preservatives; alkalis; hydrotropic compounds; antioxidants; solvents and solubilizers, such as ethanol, glycerol, propanediol; dispersants, antiredeposition agents; graying inhibitors; softeners; antistats; dyes and perfumes.

Dyes

The term dyes here encompasses both water-soluble dyes and insoluble chromatic pigments. Water-soluble dyes are, though, used with preference in liquid washing compositions. These include the groups of the acid dyes, direct dyes and reactive dyes. It is possible to assign, for example, representatives of the azo dyes, metal complex dyes and the polycyclic dyes to these groups.

Perfume Oils and Odorants

The fragrance and perfume oils used may be individual odorant compounds, for example the synthetic products of the ester, ether, aldehyde, ketone, alcohol and hydrocarbon type. Preference is given to using mixtures of different odorants which together generate a pleasing fragrance note.

Perfume oils may also comprise natural odorant mixtures and essential oils of low volatility.

Optical Brighteners

These include in particular the brighteners of the diaminostilbene and distyrylbiphenyl type.

Dye Transfer Inhibitors

These include polyamine N-oxides, for instance poly(4-vinylpyridine N-oxide), poly(4-vinylpyridine betaine), polyvinylpyrrolidone and copolymers of N-vinylpyrrolidone with N-vinylimidazole and optionally other monomers, polyvinylimidazole, and also cyclodextrins and cyclodextrin derivatives.

EXAMPLES

Comparative examples 1 to 4 demonstrate the incompatibility of anionic surfactants with the dye fixatives (DF) and the problem of preparing stable anionic liquid washing compositions.

Examples 1 to 7 describe stable liquid washing composition formulations based on the anionic surfactant Hostapur SAS and polymeric dye fixatives (DF).

The following anionic surfactants were used for the experiments:

- sec. alkanesulfonate: Hostapur SAS 60=sec. $C_{13-17}$-alkanesulfonate, sodium salt, 60% strength
- ether sulfate: Genapol LRO paste=$C_{12/14}$-alkyl ether sulfate, sodium salt, 70% strength
- alkylsulfate: Sulfopon 101 spez.=sodium lauryl sulfate, 30%. strength
- alkylbenzenesulfonate: Marlon A 365=$C_{10}$-$C_{13}$-alkylbenzenesulfonate, sodium salt, 65% strength

Comparative Example 1

Incompatibility of Anionic Surfactants with Dye Fixatives

Aqueous solutions with an anionic surfactant content of 5 or 15% (active substance) and a content of 1% (active substance) of the dye fixatives were prepared and assessed visually (see tables 1 and 2). The pH was not regulated. The references used were the surfactant solutions without dye fixative.

TABLE 1

Incompatibility of anionic surfactants, 5% strength, pH tq. with dye fixatives

| | 5% surfactant solutions with addition of 1% DF . . . | | | | |
|---|---|---|---|---|---|
| Surfactants | no DF | DF 1 | DF 2 | DF 3 | DF 4 |
| sec. alkanesulfonate | clear | flocculation | flocculation | flocculation | flocculation |
| alkyl ether sulfate | clear | flocculation | flocculation | flocculation | flocculation |
| alkylsulfate | opaque | flocculation | flocculation | flocculation | flocculation |
| alkylbenzenesulfonate | clear | flocculation | flocculation | flocculation | flocculation |

TABLE 2

Incompatibility of anionic surfactants, 15% strength, pH tq. with dye fixatives

| | 15% surfactant solutions with addition of 1% DF . . . | | | | |
|---|---|---|---|---|---|
| Surfactants | no DF | DF 1 | DF 2 | DF 3 | DF 4 |
| sec. alkanesulfonate | clear | flocculation | flocculation | flocculation | flocculation |
| alkyl ether sulfate | clear | flocculation | flocculation | flocculation | flocculation |
| alkylsulfate | opaque | flocculation | flocculation | flocculation | flocculation |
| alkylbenzenesulfonate | clear | flocculation | flocculation | flocculation | flocculation |

Comparative Example 2

Incompatibility of Anionic Surfactants with Dye Fixatives

Aqueous solutions with an anionic surfactant content of 5 or 15% (active substance) and a content of 1% (active substance) of the dye fixative were prepared. The pH was adjusted to 9, since washing compositions generally have an alkaline pH. The solutions were assessed visually (see tables 3 and 4). The references used were the surfactant solutions without dye fixatives, which have likewise been adjusted to pH=9.

TABLE 3

Incompatibility of anionic surfactants, 5% strength, pH = 9, with dye fixatives

| | 5% surfactant solutions with addition of 1% DF . . . | | | | |
|---|---|---|---|---|---|
| Surfactants | no DF | DF 1 | DF 2 | DF 3 | DF 4 |
| sec. alkanesulfonate | clear | flocculation | flocculation | flocculation | flocculation |
| alkyl ether sulfate | clear | flocculation | flocculation | flocculation | flocculation |
| alkylsulfate | opaque | flocculation | flocculation | flocculation | flocculation |
| alkylbenzenesulfonate | clear | flocculation | flocculation | flocculation | flocculation |

TABLE 4

Incompatibility of anionic surfactants, 15% strength, pH = 9, with dye fixatives

| | 15% surfactant solutions with addition of 1% DF . . . | | | | |
|---|---|---|---|---|---|
| Surfactants | no DF | DF 1 | DF 2 | DF 3 | DF 4 |
| sec. alkanesulfonate | clear | flocculation | flocculation | flocculation | flocculation |
| alkyl ether sulfate | clear | flocculation | flocculation | flocculation | flocculation |
| alkylsulfate | opaque | flocculation | flocculation | flocculation | flocculation |
| alkylbenzenesulfonate | clear | flocculation | flocculation | flocculation | flocculation |

Comparative Example 3

Incompatibility of Hostapur SAS 60 with DF 2 and DF 3

An aqueous 13% solution (active substance) of Hostapur SAS was prepared.

The Hostapur SAS content corresponds to the stable ternary surfactant mixtures with dye fixatives (see example 1, 2 and 5 to 7).

1% (active substance) DF 2 or DF 3 was added to the solution.

TABLE 5

Incompatibility of Hostapur SAS, 13%, with DF 2 or DF 3

| | Visual assessment | | |
|---|---|---|---|
| | no DF | with DF 2 | with DF 3 |
| Hostapur SAS 60, 13% strength | clear solution | flocculation and sedimentation | flocculation and sedimentation |

Comparative Example 4

Incompatibility of Hostapur SAS with DF 2 and DF 3.

An aqueous 46% strength formulation (active substance) of Hostapur SAS was prepared.

The Hostapur SAS content corresponds to the total surfactant content of stable, ternary surfactant mixtures with dye fixatives (see examples 1 and 2, and 6 and 7). 1% (active substance) of DF 2 or DF 3 was added to the formulation.

TABLE 6

Incompatibility of Hostapur SAS, 46% strength, with dye fixatives

| | Visual assessment | | |
|---|---|---|---|
| | no DF | with DF 2 | with DF 3 |
| Hostapur SAS 60, 46% strength | homogeneous paste | flocculation/ inhomogeneity | flocculation/ inhomogeneity |

Examples of stable anionic liquid washing compositions comprising dye fixatives based on the ternary surfactant system of secondary alkanesulfonate/soap/nonionic surfactant:

Example 1

Various anionic liquid washing composition formulations with a total surfactant content of 46% (active substance) were prepared.

The anionic surfactants used were sec. alkanesulfonate and soap, the nonionic surfactant used was $C_{12/14}$-alkyl-7EO ethoxylate and the dye fixative used was DF 2.

TABLE 7

Stable anionic liquid washing composition comprising DF 2

| | Formulation: | | |
|---|---|---|---|
| Composition: | A | B | C |
| sec. alkanesulfonate | 13% | 13% | 13% |
| potash-coconut soap | 10% | 10% | 10% |
| $C_{12}/_{14}$-alkyl-7EO ethoxylate | 23% | 23% | 23% |
| 1,2-propanediol | 5% | 5% | 5% |
| citric acid | — | 1% | — |
| HEDP | — | — | 1% |
| DF 2 | 1% | 1% | 1% |
| water | ad 100% | ad 100% | ad 100% |
| assessment: | clear solution | clear solution | clear solution |

Example 2

Various anionic liquid washing composition formulations with a total surfactant content of 46% (active substance) were prepared.

The anionic surfactants used were sec. alkanesulfonate and soap, the nonionic surfactant used was $C_{12/14}$-alkyl-7EO ethoxylate and the dye fixative used was DF 3.

TABLE 8

Stable anionic liquid washing compositions comprising DF 3

| Composition: | Formulation: A | B | C |
|---|---|---|---|
| sec. alkanesulfonate | 13% | 13% | 13% |
| potash-coconut soap | 10% | 10% | 10% |
| $C_{12/14}$-alkyl-7EO ethoxylate | 23% | 23% | 23% |
| 1,2-propanediol | 5% | 5% | 5% |
| citric acid | 0.5% | 0.75% | — |
| HEDP | — | — | 0.5% |
| DF 3 | 1% | 1% | 1% |
| water | ad 100% | ad 100% | ad 100% |
| assessment: | clear solution | clear solution | clear solution |

Example 3

Two anionic liquid washing composition formulations with a total surfactant content of 36% (active substance) were prepared.

The anionic surfactants used were sec. alkanesulfonate and soap, the nonionic surfactant used was $C_{12/14}$-alkyl-7EO ethoxylate, and the dye fixative used was DF 2.

TABLE 9

Stable anionic liquid washing compositions comprising DF 2

| Composition: | Formulation: A | B |
|---|---|---|
| sec. alkanesulfonate | 9.7% | 9.7% |
| potash-coconut soap | 6.7% | 6.7% |
| $C_{12/14}$-alkyl-7EO ethoxylate | 19.7% | 19.7% |
| 1,2-propanediol | 5.0% | 5.0% |
| citric acid | — | 0.5% |
| DF 2 | 1.0% | 1.0% |
| water | ad 100% | ad 100% |
| assessment: | clear solution | clear solution |

Example 4

An anionic liquid washing composition formulation with a total surfactant content of 26% (active substance) was prepared.

The anionic surfactants used were sec. alkanesulfonate and soap, the nonionic surfactant used was $C_{12/14}$-alkyl-7EO ethoxylate, and the dye fixative used was DF 2.

TABLE 10

Anionic 26% strength liquid washing composition comprising DF 2

| Composition: | Formulation: A |
|---|---|
| sec. alkanesulfonate | 6.3% |
| potash-coconut soap | 3.3% |
| $C_{12/14}$-alkyl-7EO ethoxylate | 16.3% |
| 1,2-propanediol | 5.0% |
| DF 2 | 1.0% |
| water | ad 100% |
| assessment: | clear solution |

TABLE 10-continued

Anionic 26% strength liquid washing composition comprising DF 2

| Composition: | Formulation: A |
|---|---|

Example 5

Anionic liquid washing composition formulations with a total surfactant content of 41.4% (active substance) were prepared. The total surfactant content reduced in comparison to the formulations in example 1 and 2 resulted from a lowering in the nonionic surfactant content. The dye fixatives used were DF 2 and DF 3.

TABLE 11

Anionic 41% strength liquid washing compositions comprising DF 2 or DF 3

| Composition: | Formulation: A | B | C | D | E |
|---|---|---|---|---|---|
| sec. alkanesulfonate | 13% | 13% | 13% | 13% | 13% |
| potash-coconut soap | 10% | 10% | 10% | 10% | 10% |
| $C_{12/14}$-alkyl-7EO ethoxylate | 18.4% | 18.4% | 18.4% | 18.4% | 18.4% |
| 1,2-propanediol | 5% | 5% | 5% | 5% | 5% |
| citric acid | — | — | 0.5% | 0.75% | 1% |
| DF 2 | 1% | — | 1% | 1% | 1% |
| DF 3 | — | 1% | — | — | — |
| water | ad 100% | ad 100% | ad 100% | ad 100% | ad 100% |
| assessment: | clear solution | clear solution | clear solution | clear solution | clear solution |

Example 6

Anionic liquid washing composition formulations with a total surfactant content of 46% (active substance) were prepared.

The anionic surfactants used were sec. alkanesulfonate and soap, the nonionic surfactant used was a $C_{11}$ oxo alcohol-8EO ethoxylate, and the dye fixative used was DF 2.

TABLE 12

Stable anionic 46% strength liquid washing composition comprising DF 2

| Composition: | Formulation: A | B | C |
|---|---|---|---|
| sec. alkanesulfonate | 13% | 13% | 13% |
| potash-coconut soap | 10% | 10% | 10% |
| $C_{11}$ oxo alcohol-8EO ethoxylate | 23% | 23% | 23% |
| 1,2-propanediol | 5% | 5% | 5% |
| citric acid | — | 1% | — |
| HEDP | — | — | 1% |
| DF 2 | 1% | 1% | 1% |
| water | ad 100% | ad 100% | ad 100% |
| assessment: | clear solution | clear solution | clear solution |

Example 7

Anionic liquid washing composition formulations with a total surfactant content of 46% (active substance) were prepared.

The anionic surfactants used were sec. alkanesulfonate and soap. The nonionic surfactant used was a $C_{11}$ oxo alcohol-8EO ethoxylate, and the dye fixative used was DF 3.

TABLE 13

Stable anionic 46% strength liquid washing composition comprising DF 3

| Composition: | Formulation: A | Formulation: B |
|---|---|---|
| sec. alkanesulfonate | 13% | 13% |
| potash-coconut soap | 10% | 10% |
| $C_{11}$ oxo alcohol 8EO ethoxylate | 23% | 23% |
| 1,2-propanediol | 5% | 5% |
| citric acid | 0.5% | — |
| HEDP | — | 0.5% |
| DF 3 | 1% | 1% |
| water | ad 100% | ad 100% |
| assessment: | opaque solution | clear solution |

Example 8

Various anionic liquid washing composition formulations with a total surfactant content of 46% (active substance) were prepared.

The anionic surfactants used were sec. alkanesulfonate and soap, the nonionic surfactant used was $C_{12/14}$-alkyl-7EO ethoxylate, and the dye fixative used was DF 5.

TABLE 14

Stable anionic liquid washing compositions comprising DF 5

| Composition: | Formulation: A | Formulation: B | Formulation: C |
|---|---|---|---|
| sec. alkanesulfonate | 13% | 13% | 13% |
| potash-coconut soap | 10% | 10% | 10% |
| $C_{12}/_{14}$-alkyl-7EO ethoxylate | 23% | 23% | 23% |
| 1,2-propanediol | 5% | 5% | 5% |
| citric acid | — | 1% | — |
| HEDP | — | — | 1% |
| DF 5 | 1% | 1% | 1% |
| water | ad 100% | ad 100% | ad 100% |
| assessment: | clear solution | clear solution | clear solution |

Example 9

Various anionic liquid washing composition formulations with a total surfactant content of 46% (active substance) were prepared.

The anionic surfactants used were sec. alkanesulfonate and soap, the nonionic surfactant used was $C_{12/14}$-alkyl-7EO ethoxylate, and the dye fixatives used were DF 6 and DF 7.

TABLE 15

Stable anionic liquid washing composition comprising DF 6 and DF 7

| Composition: | Formulation: A | Formulation: B |
|---|---|---|
| sec. alkanesulfonate | 13% | 13% |
| potash-coconut soap | 10% | 10% |
| $C_{12}/_{14}$-alkyl-7EO ethoxylate | 23% | 23% |
| 1,2-propanediol | 5% | 5% |
| DF 6 | 1% | — |
| DF 7 | — | 1% |
| water | ad 100% | ad 100% |
| assessment: | clear solution | clear solution |

Abbreviations used:

HEDP=1-hydroxyethane-1,1-diphosphonic acid

DF=dye fixative

DF 1=reaction product of diethylenediamine, dicyandiamide and sulfamic acid.

DF 2=reaction product of dimethylamine and epichlorohydrin.

DF 3=reaction product of dicyandiamide, ammonium chloride and formaldehyde.

DF 4=reaction product of dimethylaminopropylamine and epichlorohydrin

DF 5=polydiallyldimethylammonium chloride, MM=40 000

DF 6=polydiallyldimethylammonium chloride, MM=85 000

DF 7=polydiallyldimethylammonium chloride, MM=115 000

The invention claimed is:

1. A liquid washing and cleaning composition comprising a) secondary alkanesulfonate b) soap c) a nonionic surfactant and d) a dye fixative selected from the group consisting of a homo-polymer, a copolymer, and a mixture of a homo-polymer and a copolymer of diallyldimethylammonium chloride.

2. The washing and cleaning composition as claimed in claim 1, comprising from 5 to 20% by weight of secondary alkanesulfonate.

3. The washing and cleaning composition as claimed in claim 1, comprising from 10 to 20% by weight of soap.

4. The washing and cleaning composition as claimed in claim 1, comprising from 10 to 30% by weight of nonionic surfactant.

5. The washing and cleaning composition as claimed in claim 1, comprising, as the nonionic surfactant, an ethoxylate of a synthetic or native alcohol having an HLB value of from 10 to 15.

6. The washing and cleaning composition as claimed in claim 1, wherein said composition has a mass ratio of anionic surfactants:nonionic surfactants of from 1:2 to 2:1.

7. The washing and cleaning composition as claimed in claim 1, wherein said composition is a ternary surfactant system consisting of secondary alkanesulfonate, soap and non-ionic surfactant which has a total surfactant content of 10 to 70% by weight.

8. The washing and cleaning composition as claimed in claim 1, comprising from 7 to 17% by weight secondary alkanesulfonate.

9. The washing and cleaning composition as claimed in claim 1, comprising from 7 to 13% by weight of secondary alkanesulfonate.

10. The washing and cleaning composition as claimed in claim 1, comprising from 15 to 25% by weight of nonionic surfactant.

11. The washing and cleaning composition as claimed in claim 1, comprising from 17 to 23% by weight of nonionic surfactant.

12. The washing and cleaning composition as claimed in claim 1, comprising, as the nonionic surfactant, an ethoxylate of a synthetic or native alcohol having an HLB value of from 11 to 14.

13. The washing and cleaning composition as claimed in claim 1, wherein said composition has a mass ratio of anionic surfactants:nonionic surfactants of 0.8:1 to 1.5:1.

14. The washing and cleaning composition as claimed in claim 1, wherein said composition is a ternary surfactant system consisting of secondary alkanesulfonate, soap and non-ionic surfactant which has a total surfactant content of 10 to 55% by weight.

15. The washing and cleaning composition as claimed in claim 1, wherein said composition is a ternary surfactant system consisting of secondary alkanesulfonate, soap and non-ionic surfactant which has a total surfactant content of 20 to 45% by weight.

* * * * *